US005890973A

United States Patent [19]

Gamble

[11] Patent Number: 5,890,973

[45] **Date of Patent: *Apr. 6, 1999**

[54] GOLF CLUB

[76] Inventor: Christopher L. Gamble, P.O. Box 9154, Canoga Park, Calif. 91309

[ * ] Notice: The term of this patent shall not extend beyond the expiration date of Pat. No. 5,628,697.

[21] Appl. No.: 842,970

[22] Filed: Apr. 25, 1997

Related U.S. Application Data

[63] Continuation-in-part of Ser. No. 560,528, Nov. 17, 1995, Pat. No. 5,628,697.

[51] Int. Cl.[6] ..... A63B 53/04

[52] U.S. Cl. ..... 473/326; 473/332

[58] Field of Search ..... 273/170; 473/326, 473/332, 333, 345, 346

[56] References Cited

U.S. PATENT DOCUMENTS

| | | | |
|---|---|---|---|
| 2,460,435 | 2/1949 | Schaffer | 473/346 |
| 3,589,731 | 6/1971 | Chancellor | 473/333 |
| 4,461,481 | 7/1984 | Kim | 473/333 |
| 4,655,458 | 4/1987 | Lewandoski | 473/326 |
| 5,464,211 | 11/1995 | Atkins, Sr. | 473/346 |
| 5,586,947 | 12/1996 | Hutin | 473/332 |
| 5,586,948 | 12/1996 | Mick | 473/346 |
| 5,628,697 | 5/1997 | Gamble | 473/326 |
| 5,643,111 | 7/1997 | Igarashi | 473/332 |

FOREIGN PATENT DOCUMENTS

| | | | |
|---|---|---|---|
| 1056979 | 2/1967 | United Kingdom | 273/170 |

*Primary Examiner*—Mark S. Graham
*Attorney, Agent, or Firm*—Gregory J. Nelson

[57] ABSTRACT

A golf club having a head defining a recess which receives an insert. In a preferred embodiment, the insert includes a conical head and a projection extending rearwardl from the cap to the rear of the club to reinforce the face of the club and transmits impact forces to the rear of the club.

9 Claims, 2 Drawing Sheets

GOLF CLUB

CROSS-REFERENCE TO RELATED APPLICATION

The present invention is a continuation-in-part of application Ser. No. 08/560,528, filed Nov. 17, 1995, U.S. Pat. No. 5,628,697 entitled "GOLF CLUB".

FIELD OF THE INVENTION

The present invention relates in general to an improved golf club and more specifically to a golf club head having an insert which enhances the effective area of the "sweet spot" and delivers greater impact to the ball when it is struck.

BACKGROUND OF THE INVENTION

Golf clubs are generally grouped by type into woods, irons and putters. Putters are used primarily for striking the ball on the green. Irons generally provide varying loft from wedges to a one iron and are normally used for playing the ball from short distances with a higher degree of loft to intermediate distances up to about 200 yards. Wood style golf clubs are generally used for longer distance driving of the golf ball and may be fabricated of wood or metal such as stainless steel, aluminum or various alloys. Clubs of this latter type are generally termed or referred to by golfers as "woods" notwithstanding the particular material from which they are fabricated.

When using woods, as indicated above, the object is to drive the golf ball long distances along a desired flight path, usually straight, although in some cases a slight fade or hook is desired. To achieve optimum distance, it is important to strike the ball squarely on the hitting area or "sweet spot" of the club with the greatest possible club head speed which the golfer can achieve. Achieving the proper golf club speed is a matter of technique which must be learned often by arduous practice. Providing a solid impact area can be improved by the club design and materials. As indicated above, many current golf club designs rely on the use of improved materials for club heads and shafts such as metal alloys to improve the ball impact velocity to achieve a longer ball flight path. It is known, for example, to vary the weight distribution to improve the impact. Typical of such to designs are the well-known cavity and perimeter weighted club designs. It is also known to place metal plates in the face of wooden head clubs in the striking area to improve impact.

While these approaches have, to some degree, improved the golf club design and improved the ability of the user to strike the ball squarely, there nevertheless exists the need for improved golf clubs, particularly the wood type.

It is known that concentrating the mass in a wood style golf club at or behind the point of impact tends to increase the horizontal spin on the ball, thus tending to cause hooks and slices. This is believed to be caused by the club striking the ball somewhat off center. When an offset impact occurs and mass is concentrated behind the "sweet spot", a force is exerted which tends to rotate the club shaft about its axis so that the face is not perpendicular to the desired flight path. This imparts a slice or hook to the ball depending on the direction of spin. When the club head mass is concentrated in the extremity of the golf club rather than behind the "sweet spot", the moment of inertia is increased and there is more resistance to the club head rotation upon impact of the ball.

Another approach is to utilize various metal alloys in order to achieve light weight. Many of these clubs are hollow. If metallic clubs are solid, they often become too heavy for practical use. However, hollow club heads tend to provide a tinny sound upon impact which does not appeal to some golfers. Furthermore, if the face of a hollow club is too thin, it may deform upon impact affecting the golf shot.

Various patents relating to golf club heads having various structures within the golf club head can be found in the prior art including the following: U.S. Pat. Nos. 3,589,731; 4,655,458; 5,046,740; 4,461,481; 2,592,013; and 5,452,897. U.S. Pat. No. 5,586,948 discloses a golf club head with a metal sleeve filled with polyurethane.

SUMMARY OF THE INVENTION

In view of the foregoing problems and shortcomings of current club designs, the present invention provides a golf club head which may be made of various materials and which includes an insert which enlarges the "sweet spot". The insert includes a conical cap, preferably of metal, which extends rearwardly from the rear of the face plate. A projection extends rearwardly from the cap to the rear of the club. This construction is believed to add to the acceleration of the club and the impact delivered to the ball as the club increases the effective area of the "sweet spot". A ball not precisely struck with the club will nevertheless result in an acceptable shot, not having excessive fade or draw.

BRIEF DESCRIPTION OF THE DRAWINGS

In view of the above and other objects and advantages of the present invention it will become more apparent upon review of the following detailed description of the invention below taken together with the drawings in which.

DETAILED DESCRIPTION OF THE PREFERRED EMBODIMENT OF THE INVENTION

Figure 1:
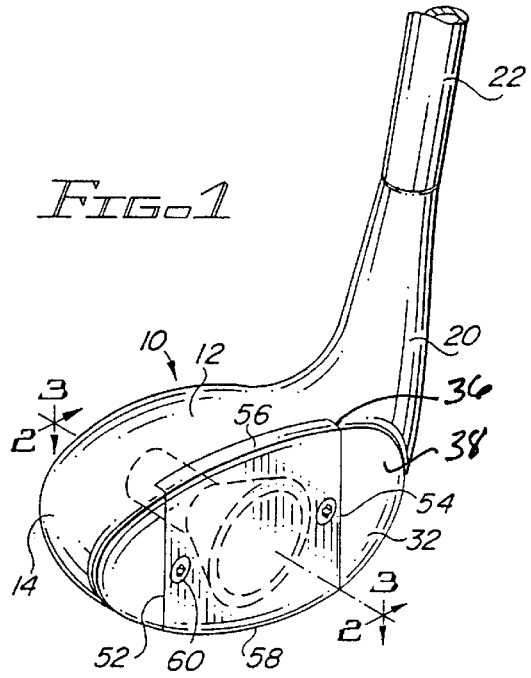
FIG. 1 is a perspective view of the head and a portion of a shaft of a golf to club according to the present invention as viewed from the face of the club.

For convenience, the same reference numerals are used to identify the same or identical components throughout the various drawing figures.

Turning first to FIG. 1, a golf club according to the present invention is shown and is generally designated by the numeral 10. The club has a head 12 which has a top surface 14 and a sole 16 which curves rearwardly to a rear surface 18. A hosel 20 is integrally formed with the head and, as is conventional, provides a location for attachment of shaft 22. The shaft 22 may be of any conventional material such as steel, graphite, titanium or other of the more exotic materials currently used in golf club shaft construction. The golf club head 12 defines an internal cavity 30 which extends to the front face 32 of the club. Club head 12 may be constructed of any suitable material such as wood, metal or even plastic.

Figure 4:
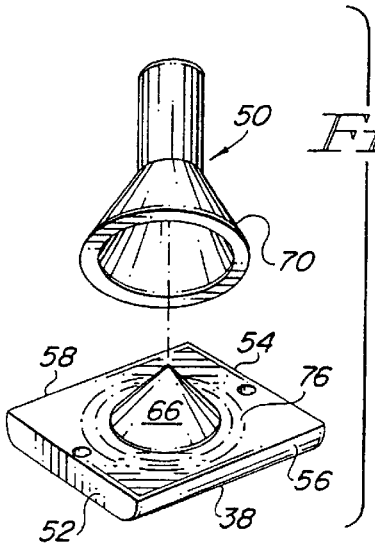
FIG. 4 is an exploded perspective view showing the face plate and cap components of the golf club head.
Figure 2:
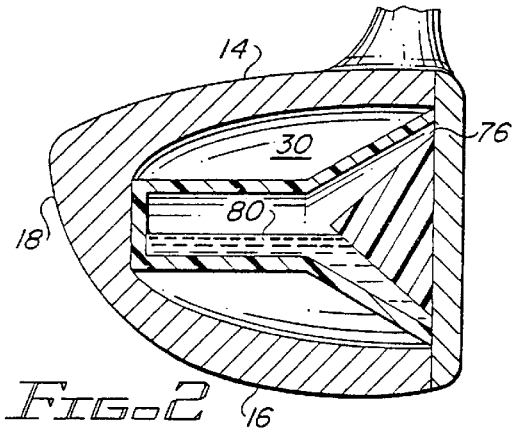
FIG. 2 is a sectional view taken along line 2—2 of FIG. 1.
Figure 3:
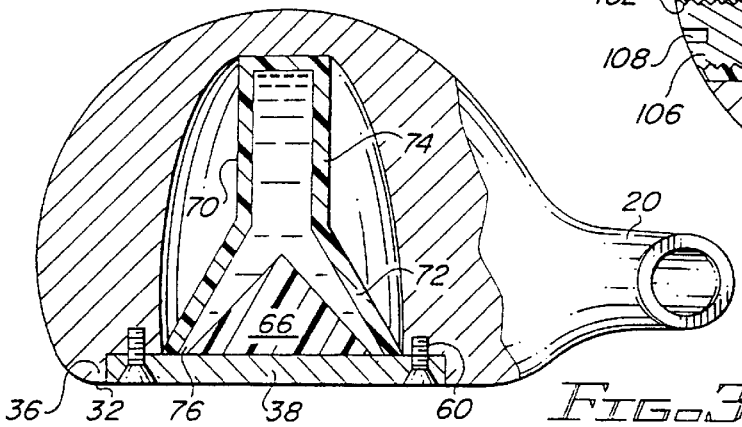
FIG. 3 is a sectional view taken along line 3—3 of FIG. 1.
Figure 7:
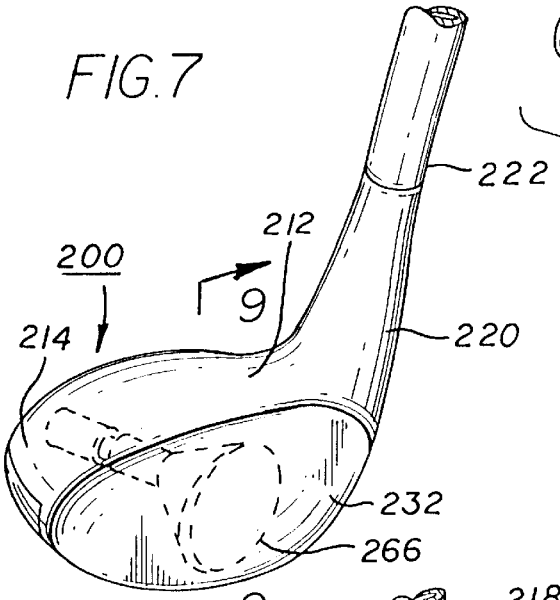
FIG. 7 is a perspective view of the head and a portion of a shaft of a golf club according to the present invention as viewed from the face of the club.

As best seen in FIG. 3, the face 32 of the club is provided with a recess 36 which receives the face plate 38 of the impact-enhancing insert 50. The components of the insert are best seen in FIG. 4 and include the face plate 38 which is shown as having opposite sides 52 and 54 and upper and lower edges 56 and 58 which conform to the contour of the upper and lower surfaces of the club head. The insert may be plastic, but is preferably metal and is secured to the head of the club at recess 36 by a pair recessed fasteners 60 shown as screws.

Extending rearwardly from the rear surface of face plate 38 is a projection 66 which is shown as being conical and centrally positioned with respect to the face plate 38. Projection 66 may be integrally formed as part of the face plate or may be a metal or plastic component secured to the rear surface of the face plate by a suitable adhesive or by other joining methods such as welding or soldering.

The diameter of the base of the projection 66 may vary depending upon the size of the face plate and the size of the club but typically would be in the range of approximately 2 to 4 centimeters depending on the club head size. The projection extends rearwardly within cavity 30 a depth corresponding approximately one- fourth to one-third of the front-to-rear club dimension. A cap 70 also extends rearwardly from the face plate 38 and has a conical wall 72 spaced from conical projection 66. The cap 72 may also include a integrally formed rearwardly extending cylindrical section 74. The cap defines an internal chamber 75 with the projection 66. The chamber 75 is annular at 76 at the rear edge of the face plate which annular area projected on the rear of the face place being shown in phantom lines in FIG. 4. The chamber 75 is filled with a fluid 80, preferably a fluid having a high specific gravity such as mercury. The chamber may be completely filled or partially filled with fluid. However, PGA rules regarding design of golf clubs do not permit a moveable element within the head of a golf club so that by completely filling the chamber, it is believed the club will comply with PGA requirements. The fluid acts in the annular area 76 and also behind the conical projection 66 to effectively increase the sweet spot and also concentrate the mass of the club at the location where the ball is normally struck. This design should also reduce the tendency of a club to rotate or twist when the ball impact point is offset from the center of the club area defined by the annulus 76.

The present design also helps to avoid the tinny or metallic pinging sound which is associated with many metal woods and which some golfers find objectionable. By locating the insert assembly 50 within a cavity 30 in the club head, overall club head weight can be reduced and yet provide substantial mass in the ball striking area.

While mercury is the preferred fluid because of its density, in some cases it may be desirable to use other fluids such as a viscous, highly refined oil, a silicon gel, or glycerin containing small metallic balls or beads. The balls or beads are similar to b-b shot, and may be steel, brass, copper, lead or similar material. The metallic balls or shots will flow with the fluid or within the fluid. However, it is noted that the fluid is sealed within an enclosed chamber and leakage should not occur through normal use of the club.

Figure 5:
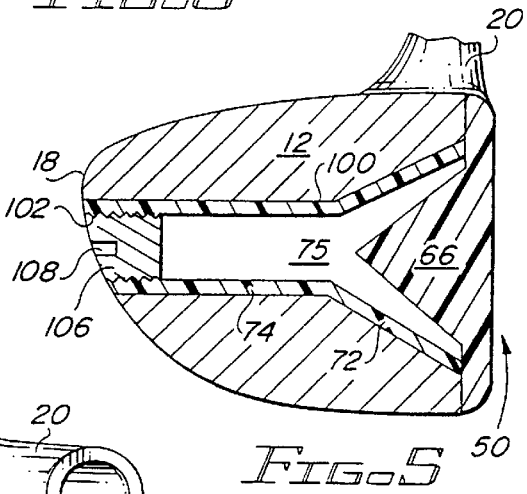
FIG. 5 is a cross-sectional view similar to FIG. 2 showing an alternate embodiment of the present invention in which the volume of the fluid-containing chamber may be accessed by a threaded plug in the rear of the club head.

FIG. 5 shows an alternate embodiment of the present invention in which a golf club head 12 is connected to a hosel 20. The interior of the club is bored at 100 to receive the insert assembly 50. The insert assembly 50 is generally as described with reference to previous figures having a generally planar base plate 38, the rear surface of which is provided with a rearwardly extending conical projection 66. A cap 70 having a conical portion 72 and a rearwardly extending cylindrical section 74 define an internal chamber which receives a suitable viscous, high density fluid. In the embodiment of FIG. 5, the conical portion 74 of the insert 50 extends rearwardly to the rear surface 18 of the golf club head. The inner surface of the cylindrical section 74 is threaded at 102 and receives a plug 106 which may be conveniently rotated by means of notch 108. The outer surface of the plug is curved at 110 to generally conform to the rear surface 18 of the golf club. Access to the chamber 75 is accomplished by removing plug 106. Generally chamber 75 will contain approximately 12 to 15 grams of fluid. The amount of the fluid can be varied since the user has convenient access to the chamber 75. Also, the total volume of the chamber can be adjusted to some extent by turning the plug to move it in a direction towards the face plate.

Figure 6:
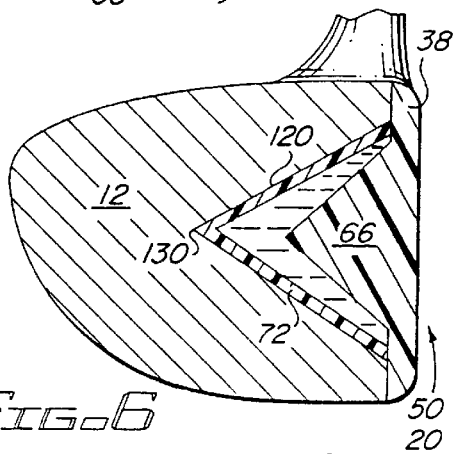
FIG. 6 is a cross-sectional view of still another embodiment of the golf club of the present invention.

In FIG. 6, the golf club head 12 is again shown having a recess 120 which is generally conical shape. The insert 50 has a face plate 38 with a rearwardly extending projection 66. A cap has a generally conical wall 72 which terminates at apex 130 defining a chamber 75 in the area between the cap and the projection 66. The chamber is filled with a suitable fluid such as mercury or other fluids and metallic shot as descnbed above. In the embodiment FIG. 6, the area of the chamber 75 would be generally smaller and is shown with respect to previous embodiments. The insert can be made as an integral unit and is inserted in the club face.

Turning now to FIGS. 7 to 11, an alternate embodiment of a golf club according to the present invention is shown and is generally designated by the numeral 200. The club has a head 212 which has a top surface 214 and a sole 216 which curves rearwardly to a rear surface 218. A hosel 220 is integrally formed with the head and, as is conventional, provides a location for attachment of shaft 222. The shaft 222 may be of any conventional material such as steel, graphite, titanium or other of the more exotic materials currently used in golf club shaft construction. The golf club head 212 defines an internal chamber 230 or hollow chamber which extends behind the front face 232 of the club. Club head 212 may be constructed of any suitable material such as wood, metal or even plastic or composites such as carbon fiber, titanium or graphite.

Figure 12:
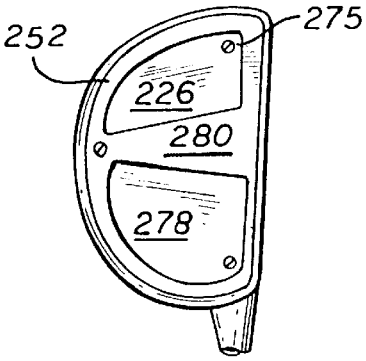
FIG. 12 is a bottom view of the golf club head having a sole plate with cavities formed therein.

The sole has a perimeter edge 262 which conforms to the contour of the lower surface of the club head. A sole plate 252 is secured to the bottom of the head of the club at threaded bores in tabs 250, 250A and 250B by three recessed fasteners 264 shown as screws. In FIG. 12, the sole plate 252 is shown secured in place by screws 275. The sole plate has recesses or cavities 276 and 278 on opposite sides of land area 280. The land area accommodates the insert 254 and the opposed cavities assist in concentrating the impact area and in balancing the club. Polymeric foam or other light weight filler material may be injected into chamber 230.

Figure 8:
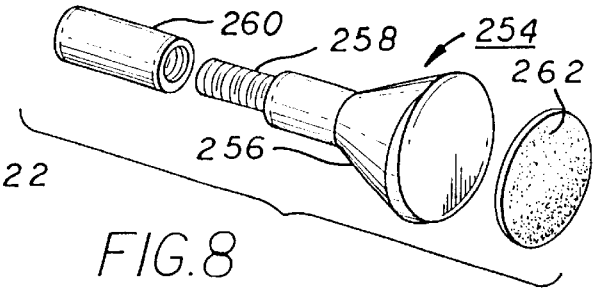
FIG. 8 is an exploded perspective view showing the conical cap and rearward projection components of the insert.
Figure 10:
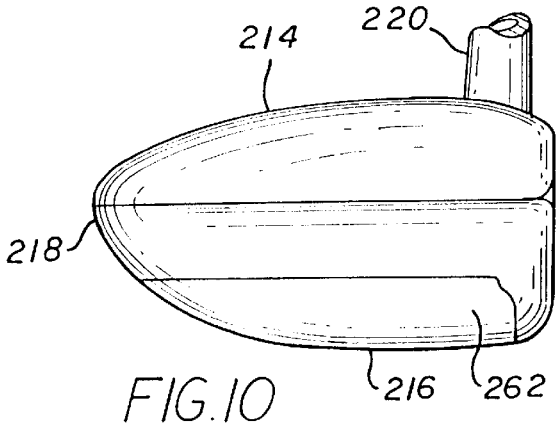
FIG. 10 is a view of the toe of the golf club head showing the sole plate attached.
Figure 9:
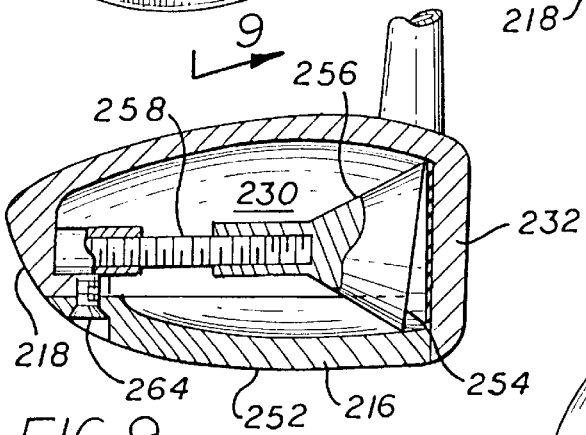
FIG. 9 is a sectional view taken along line 9—9 of FIG. 7.
Figure 11:
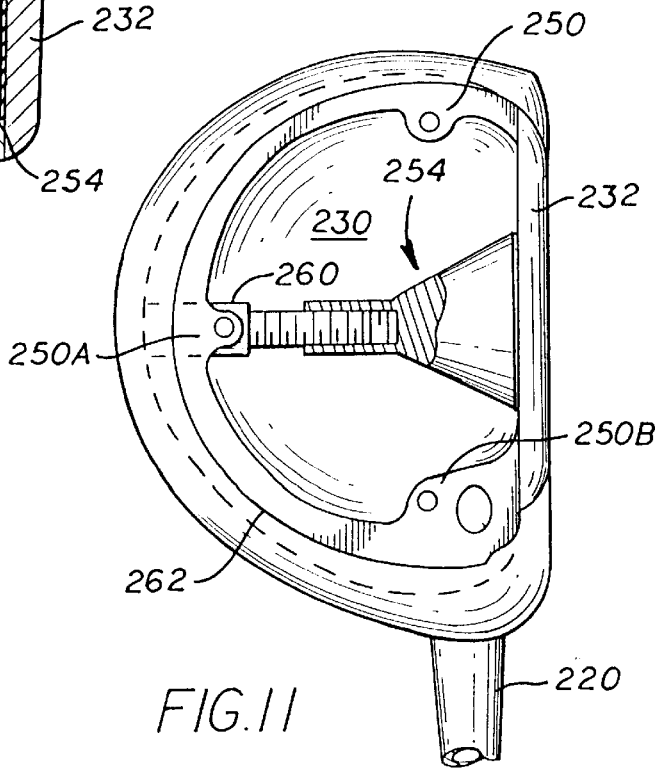
FIG. 11 is a bottom view of the golf club head with the sole plate removed.

Extending rearwardly from the rear surface of face plate 238 to the rear of the internal cavity is an insert 254. The insert is accessible by removal of the sole plate 252. The components of the insert 254 are best seen in FIG. 8 and include to a conical cap 256 having a threaded projection 258 extending axially rearwardly and received by a threaded tube 260. A resilient pad 262 may cover the face of the conical head 256. The insert 254 may be plastic, a composite, but is preferably a light weight metal.

The cap 256 is centrally positioned with respect to the face plate 232 and defines a circular area 266 on the rear of the face plate 232. The diameter of the circular area may vary depending upon the size of the face plate and the size of the club, but typically would be approximately between 2 to 4 cm depending on the club head size. The conical cap may be hollow or may be solid.

Extending rearwardly from the cap to the rear of the club is threaded projection 258 extending to and received in threaded tube 260. The threaded tube may be integrally formed as a part of the rear surface of the club head within the cavity 230 or may be a metal or plastic component secured to the rear surface of the face plate by a suitable adhesive or by other bonding methods such as welding or soldering. Installation is easily accomplished by removing the sole plate 252.

The insert 254 effectively increases the "sweet spot" and also concetrates the mass of the club at the location where the ball is normally struck. This design should also reduce the tendency of a club to rotate or twist when the ball impact point is offset from the center of the area 266 placing the insert and tube in the cavity with the threaded projection 258 engaged to a depth to facilitate placement. Once in position, the tube 260 is secured and the cap then rotated to extend it to bring it into engagement with the rear of the face place. The result is that impact forces applied to the face plate will be resisted by the face plate, insert and the rear of the club head. Impact forces should be increased. Further, the club head is legal by PGA standards since no moving components are included as part of the club head.

If fluid or other material is contained within cap 256, mercury, oil, silicone or an elastomeric or resilient material of the type sold under the trademark "Silly Putty" may be used.

The present embodiment may or may not include a fluid or other material within the cap 256. The present embodiment also helps to avoid the tinny or metallic pinging sound which is associated with many metal woods and which some golfers find objectionable. By locating the insert 254 within the cavity 230 in the club head, overall club head weight can be reduced and yet provide substantial mass and reinforcement to the ball striking area and also provides support for the face place as impact will be absorbed by the face plate, insert and rear of the club head.

While the invention has been particularly shown and described with reference to several embodiments, it will be understood by those skilled in the art that various other modifications and changes can be made to the present invention utilizing the principles of the invention as descnbed without departing from the spirit and scope of the invention as defined and encompassed in the accompanying claims.

I claim:

1. In a golf club head having a face, a sole, top and a rear portion, said head defining a hollow interior chamber disposed between said face and rear portion, the improvement comprising:

(a) a fixed insert positioned in said hollow interior chamber, said insert having a generally conical cap with a generally circular flat surface disposed against the rear surface of the face, said insert defining a hollow interior cavity and terminating at a threaded section;

(b) a threaded member extending in said chamber from said threaded section to the rear portion and being axially adjustable to vary the force applied to said face by said cap; and (c) a material having fluid characteristics substantially filling said cavity in said insert.

2. The golf club head of claim 1 wherein said cap has a face which defines a generally circular area projected on said golf club face.

3. The golf club head of claim 1 wherein said insert is plastic.

4. The golf club head of claim 1 wherein said insert is metal.

5. The golf club head of claim 1 wherein said cap includes a resilient pad at the rear of said face.

6. The golf club head of claim 1 wherein said golf club head is metal and further includes a removable sole plate.

7. The golf club head of claim 1 wherein said insert is a composite material.

8. The golf club of claim 1 wherein said head includes a sole plate, said sole plate having recessed areas defined therein located on opposite sides of said insert.

9. The golf club of claim 1 wherein said hollow interior chamber contains a resilient material.

* * * * *